US009555422B2

(12) United States Patent
Zhao et al.

(10) Patent No.: US 9,555,422 B2
(45) Date of Patent: Jan. 31, 2017

(54) IRRIGATION SPRAY NOZZLES FOR RECTANGULAR PATTERNS

(75) Inventors: Chunling Zhao, Laurel, MD (US); Shridhar Gopalan, Westminster, MD (US)

(73) Assignee: DLHBOWLES, INC., Canton, OH (US)

( * ) Notice: Subject to any disclaimer, the term of this patent is extended or adjusted under 35 U.S.C. 154(b) by 1394 days.

(21) Appl. No.: 12/610,116

(22) Filed: Oct. 30, 2009

(65) Prior Publication Data

US 2011/0089250 A1 Apr. 21, 2011

Related U.S. Application Data

(60) Provisional application No. 61/193,125, filed on Oct. 30, 2008.

(51) Int. Cl.
*B05B 1/08* (2006.01)
*B05B 3/02* (2006.01)

(52) U.S. Cl.
CPC .. *B05B 1/08* (2013.01); *B05B 3/02* (2013.01); *Y10T 137/6851* (2015.04)

(58) Field of Classification Search
CPC ..... B05B 1/08
USPC ..... 239/589.1, 422, DIG. 3, 589, 99, 101, 239/242; 137/826, 833, 814, 815
See application file for complete search history.

(56) References Cited

U.S. PATENT DOCUMENTS

| | | | | |
|---|---|---|---|---|
| 4,157,161 | A * | 6/1979 | Bauer | 239/11 |
| 4,185,777 | A * | 1/1980 | Bauer | 239/394 |
| 6,502,764 | B2 * | 1/2003 | Walker | 239/203 |
| 6,581,856 | B1 * | 6/2003 | Srinath | 239/589.1 |
| 6,904,626 | B1 * | 6/2005 | Hester et al. | 4/541.6 |
| 7,152,814 | B1 * | 12/2006 | Schapper et al. | 239/520 |
| 2004/0164189 | A1 * | 8/2004 | Berning et al. | 239/589.1 |
| 2005/0087633 | A1 * | 4/2005 | Gopalan | 239/589.1 |
| 2006/0065765 | A1 * | 3/2006 | Hester et al. | 239/589.1 |
| 2009/0188991 | A1 * | 7/2009 | Russell et al. | 239/203 |
| 2010/0078508 | A1 * | 4/2010 | South et al. | 239/589 |

* cited by examiner

*Primary Examiner* — Ryan Reis
(74) *Attorney, Agent, or Firm* — J. Andrew McKinney, Jr.; McKinney & Associates, LLC

(57) ABSTRACT

An inexpensive, durable and efficient irrigation nozzle assembly is adapted to generate a specialized rectangular spray in a 3-jet fluidic circuit which generates a substantially planar rectangular spray from a confluence of three jets. The 3-jet geometry circuit has selected floor & taper features configured to create a customizable rectangular or triangular spray pattern. Depending on the throw desired, the nozzle assembly of the present invention can be configured with a second fluidic circuit to generate a flat fan to obtain various aspect ratios in a rectangular spray.

8 Claims, 11 Drawing Sheets

IRRIGATION SPRAY NOZZLES FOR RECTANGULAR PATTERNS

PRIORITY CLAIMS AND REFERENCE TO RELATED APPLICATIONS

This application claims priority to related and commonly owned U.S. provisional patent application No. 61/193,125, filed Oct. 30, 2008, the entire disclosure of which is incorporated herein by reference. This application is also commonly owned with related U.S. patent application Ser. Nos. 10/968,749 and 12/314,242 the entire disclosures of which is also incorporated herein by reference.

BACKGROUND OF THE INVENTION

Field of the Invention

The present invention relates to irrigation nozzles adapted for use with fluidic circuits.

Discussion of the Prior Art

Irrigation systems employ sprinkler nozzles to generate sprays of desired patterns, for use in areas having specific geometries. For example, if a rectangular area is to be irrigated, a sprinkler or irrigation nozzle adapted for generating a rectangular spray is called for. Rectangular spray nozzles therefore comprise a major category of specialty sprays in irrigation, and they are distinguished from regular sprays, which usually provide circle or arc spray pattern.

For purposes of nomenclature, LCS (Left corner strip) 110, illustrated in FIG. 1A, is a common term to describe the location and function of a specialty LCS rectangular spray nozzle 100. Similarly, RCS (Right corner strip) 120 illustrated in FIG. 1B is the common term to describe the location and function of a specialty RCS rectangular spray nozzle 102, and SST (Side strip) 130 illustrated in FIG. 1C is the common term to describe the location and function of a specialty SST rectangular spray nozzle 104.

Typically, a rectangular spray nozzle is much more difficult to design compared with the regular arc spray nozzle, because of the high gradient of throw change around the diagonal line, especially for a high aspect ratio (length/width) shape with a low PR (precipitation rate). FIGS. 2 and 3 illustrate theoretical ideal throw patterns for an irrigation area defining a 4 ft×15 ft RCS and a 4 ft×9 ft RCS spray, especially if overspray and waste are to be minimized. Since water is now an increasingly valuable commodity, overspray (outside the intended area) and waste are becoming intolerable.

For those situations where overspray beyond a desired rectangular irrigation area does not matter, fluidic oscillators can be used to generate a very uniform spray pattern. For example, commonly owned U.S. patent application Ser. No. 10/968,749 discloses a fluidic oscillator insert 18 suitable for use in spraying cleaning fluid onto a windshield and utilizes a pressurized liquid to generate a uniform spatial distribution of droplets; this fluidic oscillator has (a) an inlet for the pressurized liquid, (b) a set of three power nozzles that are fed by the pressurized liquid, (c) an interaction chamber attached to the nozzles and which receives the flow from the nozzles, where this chamber has an upstream and a downstream portion, with the upstream portion having a pair of boundary edges and a longitudinal centerline that is approximately equally spaced between the edges, and where one of the power nozzles is directed along the chamber's longitudinal centerline. Fluidic insert 18 also defines a throat from which the liquid exhausts or sprays from the interaction chamber and defines an island in the interaction chamber, where the island is situated downstream of the power nozzle that is directed along the chamber's longitudinal centerline. In the illustrated fluidic insert 18, the oscillator is further configured such that: (i) one of the power nozzles is located proximate each of the chamber's boundary edges, (ii) its nozzles are configured to accelerate the movement of the liquid that flows through the nozzles, (iii) its throat has right and left sidewalls that diverge downstream, and (iv) the power nozzles and island are oriented and scaled such as to generate flow vortices behind the island that are swept out of the throat in a manner such that these vortices flow alternately proximate the throat's right sidewall and then its left sidewall. And the fluidic oscillator with insert 18 will generate a uniform spray of droplets, but that spray is not readily adapted to spray onto a defined irrigation area with a selected shape such as a rectangle.

The present invention seeks to solve these difficulties and permit irrigation of rectangular zones with a PR (precipitation rate)≤1 inch/hour. Currently there is no fixed head nozzle in the market with such a low PR. Most current irrigation sprinklers use either a rotor or fixed heads to create a rectangular spray pattern. A rotor head sprinkler is capable of throwing long distance jet with low PR (typically 0.5 inch/hour for 4 ft×15 ft specialty spray). But since the rotor head is gear driven by flowing water, its life time is low due to the gear/shaft wear or clogging. Moreover, the gear set assembly is costly and bulky. By way of contrast, a conventional fixed head sprinkler is low in cost but has to work with a high PR (typically 2 inch/hour for 4 ft×15 ft LCS/RCS) for a full coverage.

A low PR is preferred for most of the irrigation applications. With low PR, water will be allowed to soak into the ground slowly instead of running off from soil surface. Another advantage of low PR is that with the specified pressure and flow rate supply low PR sprinklers are able to cover more area.

There is a need, therefore, for an inexpensive, durable and efficient irrigation nozzle and method for generating specialized rectangular spray patterns.

SUMMARY OF THE INVENTION

Accordingly, the present invention overcomes the above mentioned difficulties by providing an inexpensive, durable and efficient irrigation nozzle assembly adapted to generate a specialized rectangular spray resulting from the confluence of three jets.

In accordance with the present invention, a 3-jet geometry (circuit) with floor & taper features is configured to create a customizable rectangular spray pattern. Depending on the throw desired, the circuit of the present invention can be combined with a fluidic flat fan to obtain various aspect ratios in a rectangular spray.

In a preferred embodiment of the present invention, a nozzle assembly is capable of spraying full coverage to generate a rectangular irrigation pattern (e.g., 4 ft×15 ft LCS/RCS or 4 ft×9 ft LCS/RCS) with a precipitation rate ("PR") of one (1) inch/hour.

The nozzle assembly of the present invention permits irrigation of rectangular zones with a PR≤1 inch/hour. A low PR is preferred for most of the irrigation applications. With low PR, water will be allowed to soak into the ground slowly instead of running off from the soil surface. Another advantage of low PR is that with the specified pressure and flow rate supply low PR sprinklers are able to cover more area. The present invention is applicable to irrigation of rectangular zones with a PR≤1 inch/hour and when using an irrigation nozzle assembly with a fixed head.

The basic embodiment of the present invention uses a 3-jet circuit to create a spray sheet which is configurable to deliver different throw in different angles. With adjustments of flow distribution over those 3 jets, jet angles and floor/taper features, the 3-jet circuit is capable of creating a variety of spray patterns such as a 4 ft×6 ft rectangle, a 6 ft×9 ft rectangle, or a 4 ft×9 ft rectangle with a low PR of about 1 inch/hour. For high aspect ratio rectangular shapes like a 4 ft×15 ft LCS/RCS, an additional fluidic circuit is used to cover the long throw area.

The above and still further features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Referring now to FIGS. 4-17B, fluidic circuits are often configured for use in housings which define a channel, port or slot that receives and provides boundaries for the fluid paths defined in the fluidic circuit. For an illustrative example of how a fluidic oscillator or fluidic circuit might be employed, as shown in FIGS. 5A-8C, a sprinkler or nozzle assembly 800 is configured with a substantially cylindrical housing 803 with a hollow interior. Housing 803 defines a substantially tubular fluid-impermeable structure and the housing sidewall includes an array of ports or slots 810, each defining a passage or aperture with smooth interior slot wall surfaces. The interior sidewall surfaces are preferably dimensioned for cost effective fabrication using molding methods and preferably include sidewall grooves positioned and dimensioned to form a "snap fit" with ridges or tabs in mating fluidic circuit inserts.

The preferred embodiment of fluidic circuit for the present invention is illustrated in FIGS. 5A-6C.

Figure 4A:
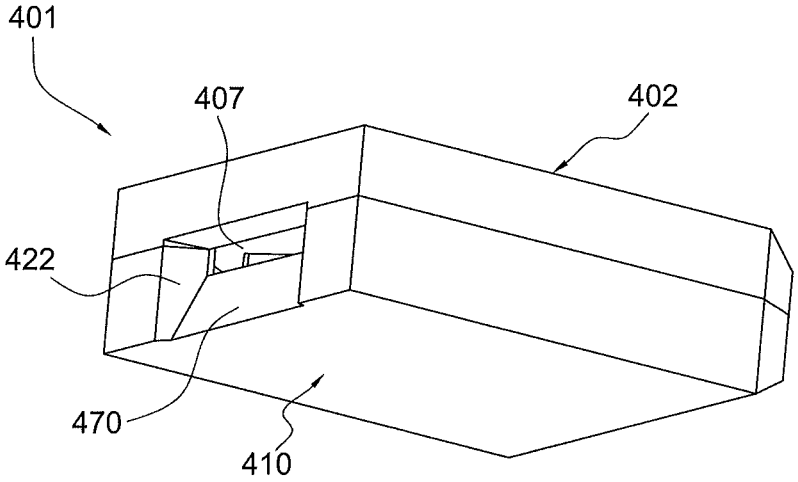
FIG. 4A illustrates an early prototype 3-jet fluid circuit assembly including a lid and a bottom portion defining first second and third jets configured to converge at an interaction point which is defined proximate selected floor and taper features in the bottom portion, in accordance with the present invention.
Figure 4B:
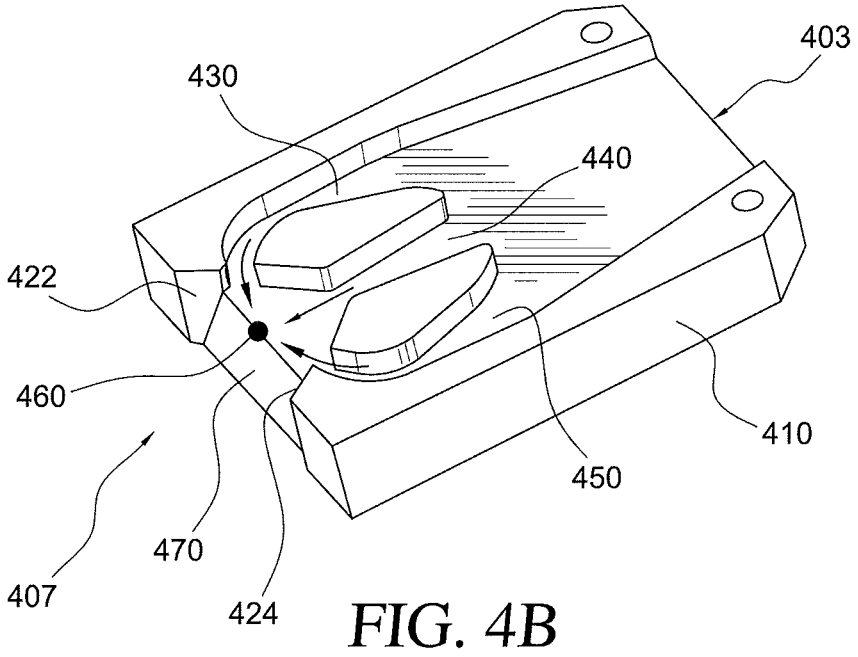
FIG. 4B is a perspective view illustrating the interior of the 3-jet fluid circuit assembly of FIG. 4A, and the bottom portion defining first second and third jets configured to converge at an interaction point which is defined proximate selected floor and taper features, in accordance with the present invention.

FIGS. 4A and 4B illustrate early prototypes, and FIGS. 4A-6B are drawn substantially to scale. FIGS. 4A and 4B illustrates an early prototype 3-jet fluid circuit assembly 401 including a lid 402 and a bottom portion 410 defining first jet nozzle 430, second or central jet nozzle 440 and third jet nozzle 450, where each of these jet nozzles is configured to generate first, second/central and third fluid jets which each directly impinge upon or converge at an interaction point or spray nexus 460 which is defined proximate a tapered floor feature 470 in the circuit assembly's bottom portion 410, in accordance with the present invention. In the illustrated embodiment, first nozzle 430 aims the first jet directly at spray nexus 460 at a first selected angle that is less than 90 degrees from the angle of incidence for second/central fluid jet (from second/central jet nozzle 440), and third nozzle 450 aims third jet directly at spray nexus 460 at an angle which is substantially equal to that first selected angle from the opposing side, to create a symmetrical array of three directly impinging jets.

Generally speaking, fluidic oscillator insert 401 has an inlet 403 configured to receive pressurized liquid and inlet 403 is in fluid communication with the three nozzles (430, 440 and 450) that are fed by the pressurized liquid. Each of the three nozzles pass the fluid to an outlet 407 which defines spray interaction nexus 460 with directly impinging flows from nozzles 430, 440 and 450. For purposes of nomenclature, the fluid flows "downstream" from inlet 403 to outlet 407, so when referring to something as "upstream", one refers to something as being closer to the inlet. Outlet 407 has an upstream and a downstream portion, with the upstream portion has a pair of boundary edges and a longitudinal centerline that is approximately equally spaced between the boundary edges. The nozzles 430, 440 and 450 are preferably are aligned along a plane and central nozzle 440 is coaxially aligned along the outlet's longitudinal centerline. Fluidic insert 401 also defines a throat from which the irrigation liquid sprays, downstream of central nozzle 440 and along the chamber's longitudinal centerline. In the illustrated fluidic insert 401, the oscillator is further configured such that nozzle 430 and nozzle 450 are each located proximate of the chamber's opposing boundary edges. As best seen in FIG. 4B, the outlet 407 from which a spray exhausts has opposing right 422 and left 424 sidewalls that diverge downstream, and outlet 407 is preferably centrally aligned directly downstream of the central nozzle 440 which is coaxially aligned with the outlet's centerline such that spray nexus 460 intersects the outlet's centerline. Each of the nozzles are preferably configured with decreasing cross sectional area (e.g., from decreasing nozzle width), going downstream, and so are configured to effectuate an increase in fluid velocity so that the fluids jets flowing from each nozzle have increased velocity when impinging with one another at spray nexus 460.

The basic concept of the present invention is using a 3-jet circuit generating first second and third directly impinging jets which define an open interaction region or spray nexus point (e.g., 460) to emit a spray sheet delivering different fluid droplet throw distances for different azimuth angles. With the adjustments of (a) flow distribution over the 3 jets, (b) jet angles and (c) floor/taper features, the 3-jet circuit is capable of creating a variety of spray patterns such as a 4 ft×6 ft rectangle spray pattern, a 6 ft×9 ft rectangle spray pattern, or a 4 ft×9 ft rectangle spray pattern, where each spray pattern is irrigated with a low PR of 1 inch/hour.

Figure 1A:
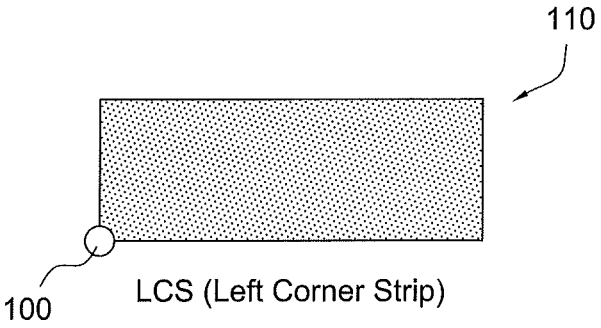
FIG. 1A is a diagram illustrating the area defined as a rectangular left corner strip (LCS), with the sprinkler or irrigation nozzle assembly designated in the lower left hand corner.
Figure 1B:
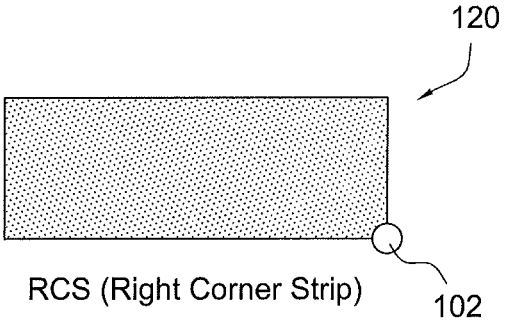
FIG. 1B is a diagram illustrating the area defined as a rectangular right corner strip (RCS), with the sprinkler or irrigation nozzle assembly designated in the lower right hand corner.
Figure 1C:
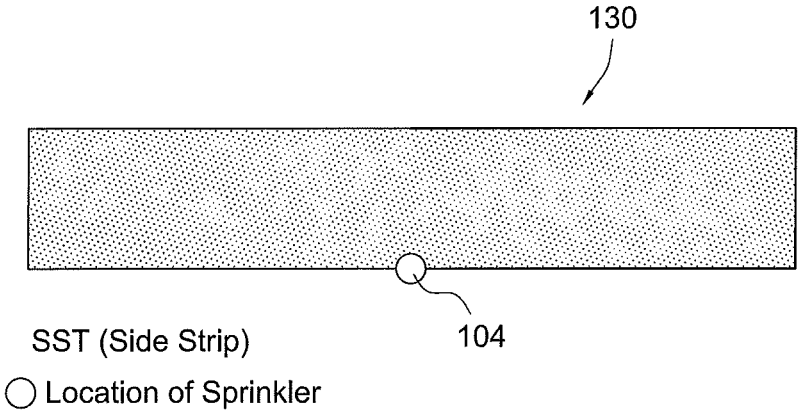
FIG. 1C is a diagram illustrating the area defined as a rectangular side strip (SST), with the sprinkler or irrigation nozzle assembly designated in the center of the lower edge.
Figure 3:
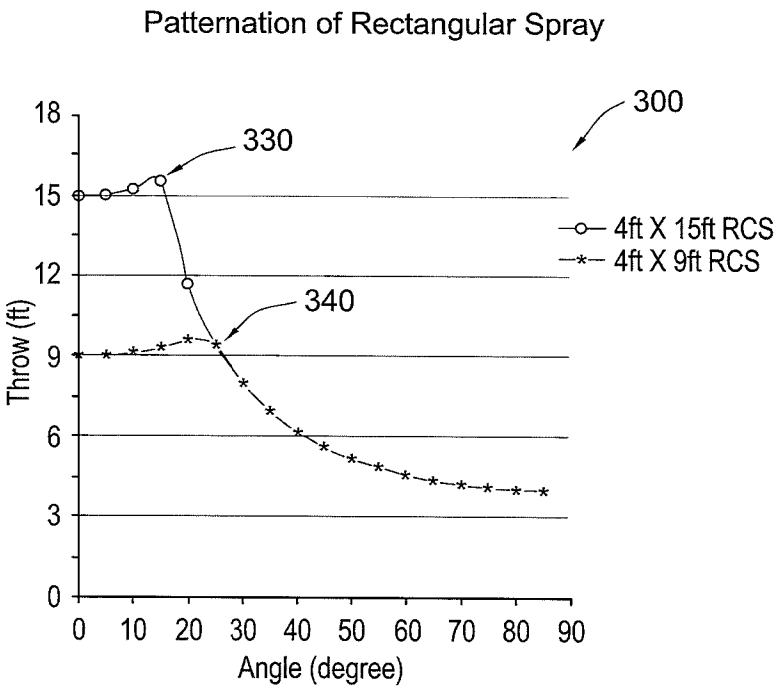
FIG. 3 is an X-Y plot showing theoretically ideal patternation (feet of throw as a function or angular azimuth in degrees) illustrating the ideal throw pattern for an irrigation area defining a 4 ft by 15 ft (shown with plot points designated "o") or 4 ft by 9 ft (shown with plot points designated "x") for the ideal RCS irrigation spray of FIG. 2.
Figure 2:
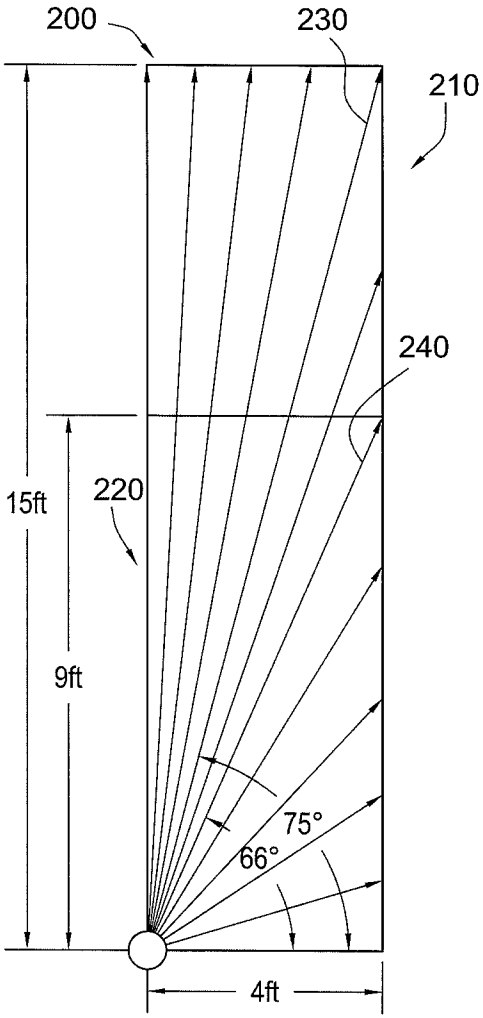
FIG. 2 is an X-Y diagram with angular graduations illustrating the ideal throw pattern for an irrigation area defining a 4 ft by 15 ft or a 4 ft by 9 ft RCS irrigation spray.

As noted above, spraying irrigation fluid precisely into a rectangular spray pattern is very challenging because of the deep gradient of the throw changes at the diagonal. Unlike a circle/arc pattern spray (with constant throw distance at all azimuth directions) the throw of a rectangular spray pattern is flat on the top edge to the left of diagonal line 230 and deeply decreases on the right side. FIGS. 2 and 3 illustrate theoretically ideal spray patterns for the 4 ft×15 ft RCS spray area 210 and the (lesser included) 4 ft×9 ft RCS spray area 220. FIG. 2 is an X-Y diagram 200 with angular graduations illustrating the ideal throw pattern for a first irrigation area defining a 4 ft by 15 ft rectangle 210 and the lesser included 4 ft by 9 ft RCS irrigation spray area 220. FIG. 3 is an X-Y plot 300 showing theoretically ideal patternation (feet of throw as a function or angular azimuth in degrees) illustrating the ideal throw pattern for an irrigation area defining a 4 ft by 15 ft area 210 (shown with plot points designated "o") and 4 ft by 9 ft area 220 (shown with plot points designated "x") for the ideal RCS irrigation spray of FIG. 2. Note that there is a sharp decrease of throw after 15° (diagonal line) 230 at 4 ft×15 ft RCS patternation curve (see 330 in FIG. 3). As for the 4 ft×9 ft RCS patternation curve, the gradient of throw change after the 24° diagonal line 240 is relatively small (see 340 in FIG. 3). The exemplary irrigation nozzle assembly of present invention is particularly for 4 ft×9 ft LCS/RCS and 4 ft×15 ft LCS/RCS.

Figure 5A:
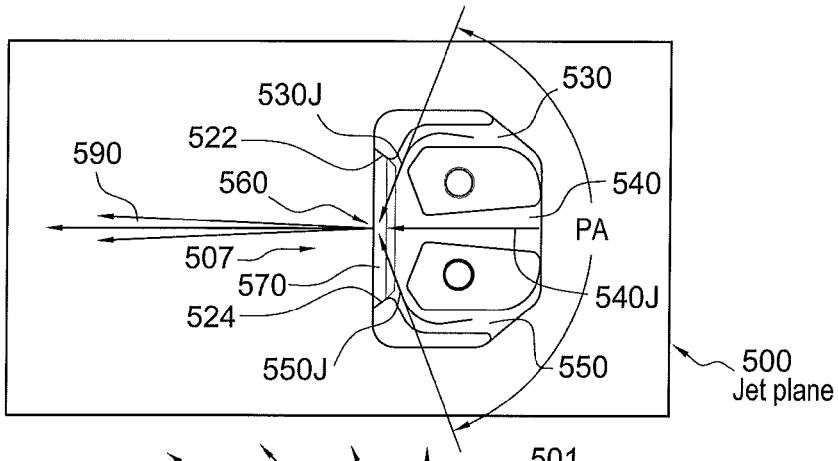
FIG. 5A illustrates the interior features in elevation for an exemplary embodiment of the 3-Jet fluidic nozzle spraying insert, in accordance with the present invention.
Figure 5B:
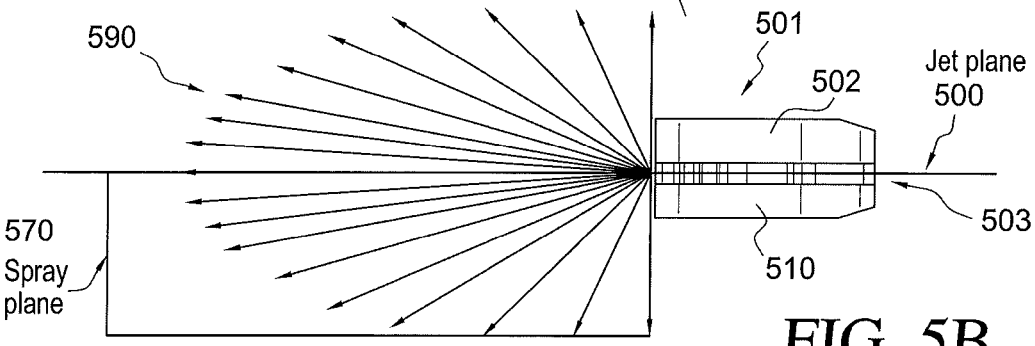
FIG. 5B illustrates a side view in elevation and partial section the 3-Jet fluidic nozzle spraying insert of FIG. 5A, in accordance with the present invention.

Turning now to the fluidic circuit illustrated in FIGS. 5A and 5B, the fluidic circuit is defined in reference to a bisecting jet plane 500. 3-jet fluid circuit assembly 501 includes a lid 502 and a circuit 510 which together define first jet nozzle 530, second or central jet nozzle 540 and third jet nozzle 550, where each of these jet nozzles is configured to generate first fluid jet 530J, second/central fluid jet 540J and third fluid jet 550J which each directly impinge upon or converge at an interaction point or spray nexus 560 which is defined proximate a tapered floor feature 570, in accordance with the present invention. In the illustrated embodiment, first nozzle 530 aims first jet 530J directly at spray nexus 560 at a first selected angle (PA/2) that is less than 90 degrees from the angle of incidence for second/central fluid jet 540J, and third nozzle 550 aims third jet 550J directly at spray nexus 560 at an angle (PA/2) which is substantially equal to that first selected angle from the opposing side, to create a symmetrical array of three directly impinging jets. As best seen in FIG. 5A, the angle defined between the central axis of flow for first jet 530J and the central axis of flow for third jet 550J is defined as PA, which is a summed angle of less than 180 degrees. Thus, 3-jet circuit assembly 501 generates first second and third directly impinging jets (530J, 540J, and 550J) which define an open interaction region or spray nexus point (e.g., 560) to create a spray sheet delivering different fluid droplet throw distances for different azimuth angles. With the adjustments of (a) flow distribution over the 3 jets, (b) jet angles and (c) floor/taper features, the 3-jet circuit 501 is capable of creating a variety of substantially rectangular spray patterns.

In use, as shown in FIGS. 5A and 5B, when first jet 530J, second jet 540J and third jet 540J interact in Jet plane 500, an ellipse-shaped wide fan pattern of spray is created and spreads in a Spray plane 570 which is vertical and perpendicular to the horizontal first, second and third jet (power nozzle) plane 500. In order to make a heavy center spray, the width of center (or second) power nozzle is selected to be 1.3 times of the width of each side (i.e., the first and third) power nozzle. The spray fan angle greatly depends on the power nozzle angle PA. In the illustrative embodiment of FIGS. 5A and 5B, PA=118°, which results in a 180° (or substantially oval or ellipse-like) spray fan.

Fluidic oscillator insert 501 fits within a housing slot or lumen defining an inlet configured to receive pressurized liquid and in fluid communication with the three nozzles (530, 540 and 550) which are fed the pressurized liquid. Each of the three nozzles pass the fluid to an outlet 507 which defines spray interaction nexus 560 with directly impinging flows from nozzles 530, 540 and 550. For purposes of nomenclature, the fluid flows "downstream" from the inlet to outlet 507, so when referring to something as "upstream", one refers to something as being closer to the inlet. Outlet 507 has an upstream and a downstream portion, with the upstream portion has a pair of boundary edges and a longitudinal centerline that is approximately equally spaced between the boundary edges. The three nozzles 530, 540 and 550 are preferably are aligned along a plane and central nozzle 540 is coaxially aligned along the outlet's longitudinal centerline. Fluidic insert 501 also defines a throat from which the irrigation liquid sprays, downstream of central nozzle 540 and along the chamber's longitudinal centerline. In the illustrated fluidic insert 501, the oscillator is further configured such that nozzle 530 and nozzle 550 are each, located proximate of the chamber's opposing boundary edges. As best seen in FIG. 5A, the outlet or throat 507 from which a spray exhausts has opposing right 522 and left 524 sidewalls that diverge downstream, and outlet 507 is preferably centrally aligned directly downstream of the central nozzle 540 which is coaxially aligned with the outlet's centerline such that spray nexus 560 intersects the outlet's centerline. Each of the nozzles are configured with decreasing cross sectional area (e.g., from decreasing nozzle width), going downstream, and so are configured to effectuate an increase in fluid velocity so that the fluids jets flowing from each nozzle have increased velocity when impinging with one another at spray nexus 560.

Some spray applications require half an ellipse. The technique of converting a 180° ellipse spray pattern into a 90° rectangular spray pattern is illustrated with the embodiment shown in FIGS. 6A and 6B.

Figure 6A:
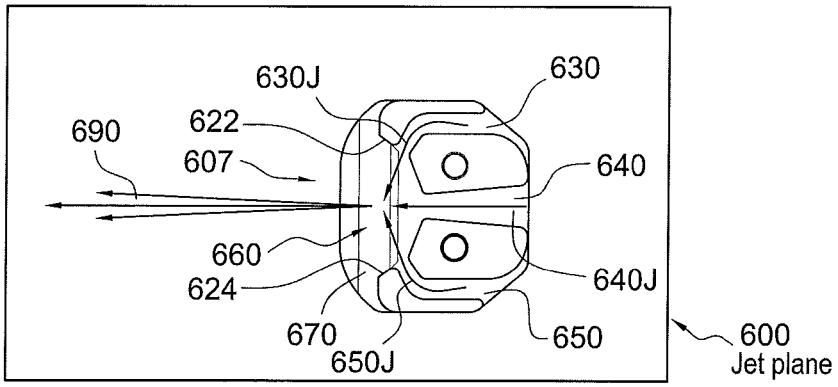
FIG. 6A illustrates the interior features in elevation for an exemplary embodiment of the 3-Jet fluidic nozzle spraying insert, in accordance with the present invention.
Figure 6B:
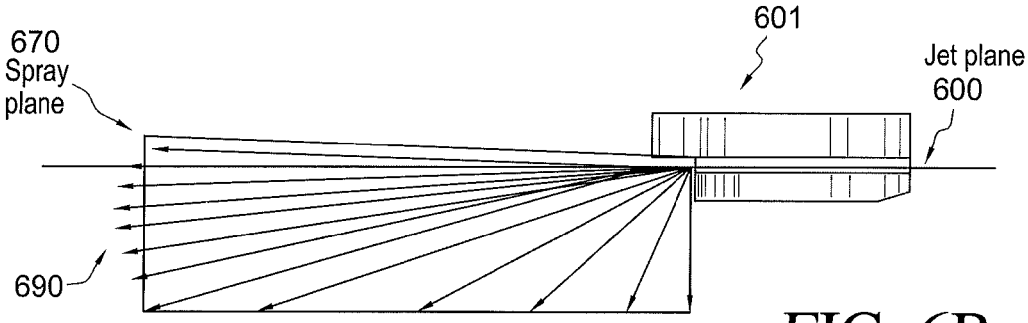
FIG. 6B illustrates a side view in elevation and partial section the 3-Jet fluidic nozzle spraying insert of FIG. 6A, in accordance with the present invention.

Turning now to the fluidic circuit illustrated in FIGS. 6A and 6B, the fluidic circuit is defined in reference to a bisecting jet plane 600. 3-jet fluid circuit assembly 601 includes a lid 602 and a circuit 610 which together define first jet nozzle 630, second or central jet nozzle 640 and third jet nozzle 650, where each of these jet nozzles is configured to generate first fluid jet 630J, second/central fluid jet 640J and third fluid jet 650J which each directly impinge upon or converge at an interaction point or spray nexus 660 which is defined proximate a distally projecting tapered upper boundary outlet feature 670, in accordance with the present invention. In the illustrated embodiment, first nozzle 630 aims first jet 630J directly at spray nexus 660 at a first selected angle that is less than 90 degrees from the angle of incidence for second/central fluid jet 640J, and third nozzle 650 aims third jet 650J directly at spray nexus 660 at an angle which is substantially equal to that first selected angle from the opposing side, to create a symmetrical array of three directly impinging jets. As best seen in FIG. 6A, the angle defined between the central axis of flow for first jet 630J and the central axis of flow for third jet 650J is defined as PA, which is a summed angle of less than 180 degrees. Thus, 3-jet circuit assembly 601 generates first second and third directly impinging jets (630J, 640J, and 650J) which define an open interaction region or spray nexus point (e.g., 660) to emit a spray sheet 690 delivering different fluid droplet throw distances for different azimuth angles. With the adjustments of (a) flow distribution over the 3 jets, (b) jet angles and (c) floor/taper features, the 3-jet circuit 601 is capable of creating a variety of substantially rectangular spray patterns.

Fluidic oscillator insert 601 fits within a housing slot or lumen defining an inlet configured to receive pressurized liquid and in fluid communication with the three nozzles (630, 640 and 650) which are fed the pressurized liquid. Each of the three nozzles pass the fluid to an outlet 607 which defines spray interaction nexus 660 with directly impinging flows from nozzles 630, 640 and 650. For purposes of nomenclature, the fluid flows "downstream" from the inlet to outlet 607, so when referring to something as "upstream", one refers to something as being closer to the inlet. Outlet 607 has an upstream and a downstream portion, with the upstream portion has a pair of boundary edges and a longitudinal centerline that is approximately equally spaced between the boundary edges. The three nozzles 630, 640 and 650 are preferably aligned along a plane and central nozzle 640 is coaxially aligned along the outlet's longitudinal centerline. Fluidic insert 601 also defines a throat from which the irrigation liquid sprays, downstream of central nozzle 640 and along the chamber's longitudinal centerline. In the illustrated fluidic insert 601, the oscillator is further configured such that nozzle 630 nozzle 650 are each located proximate the chamber's opposing boundary edges. As best seen in FIG. 6A, the outlet or throat 607 from which a spray exhausts has opposing right 622 and left 624 sidewalls that diverge downstream, and outlet 607 is preferably centrally aligned directly downstream of the central nozzle 640 which is coaxially aligned with the outlet's centerline such that spray nexus 660 intersects the outlet's centerline. Each of the nozzles are configured with decreasing cross sectional area (e.g., from decreasing nozzle width), going downstream, and so are configured to effectuate an increase in fluid velocity so that the fluids jets flowing from each nozzle have increased velocity when impinging with one another at spray nexus 660.

In the embodiment illustrated in FIG. 6A, a 1°×1 mm taper in one side of the fluidic circuit deflects half of the natural spray fan and reorganizes it into narrow heavy spray fan 690.

Applicants have found that a good combination of half natural fan and deflected fan from another half provides excellent mapping of a rectangular spray pattern. By adjusting or varying (a) relative magnitude of the size of the opposing side jets and the center jet, (b) jet angle (PA) and (c) floor & taper features, the 3-jet circuit of FIGS. 6A and 6B can be made to produce a customizable rectangular spray pattern.

As can be seen in FIGS. 6A and 6B, the first, second and third jets are aimed at a nexus or collision point 660 which is defined between the circuit and the distally projecting deflection taper. The heavy arrows in FIG. 6A illustrate fluid flow for the first, second and third jets, and the thinner arrows in FIGS. 6A and 6B illustrate trajectories of fluid droplets travelling away from the nexus or collision point 660.

Figure 7:
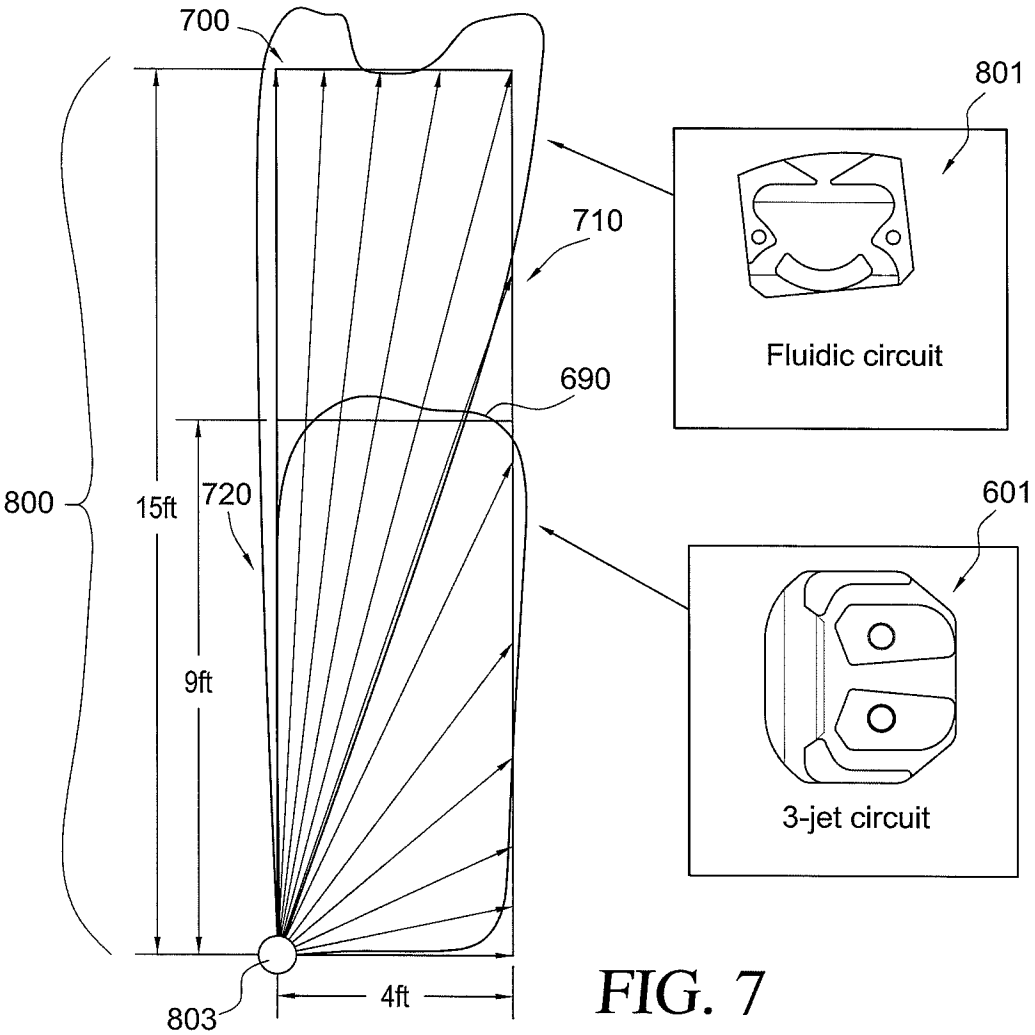
FIG. 7 is an X-Y diagram with angular graduations illustrating the observed throw pattern for a rectangular irrigation area when sprayed using the irrigation nozzle assembly of FIGS. 8A-8C including the 3-Jet fluidic of FIGS. 6A and 6B, in accordance with the present invention.

In order to prevent clogging or misty spray, the size of power nozzle should be greater than a certain value such as 0.46 mm×0.46 mm. With this restriction, the 3-jet circuit could not make full coverage of high aspect ratio (length/width) rectangular zone like 4 ft×15 ft with low PR≤1 inch/hour. To solve this problem, as shown in FIG. 7, an irrigation nozzle assembly (e.g., 800) combines a first fluidic circuit 801 (e.g., mushroom type, as described in Assignee's patent U.S. Pat. No. 6,253,782) for covering the "long distance" 15 ft×15° zone 710 and a second fluidic circuit 601 configured as a 3-jet vertical circuit is used for covering the nearby 4 ft×9 ft zone 720.

Figure 8A:
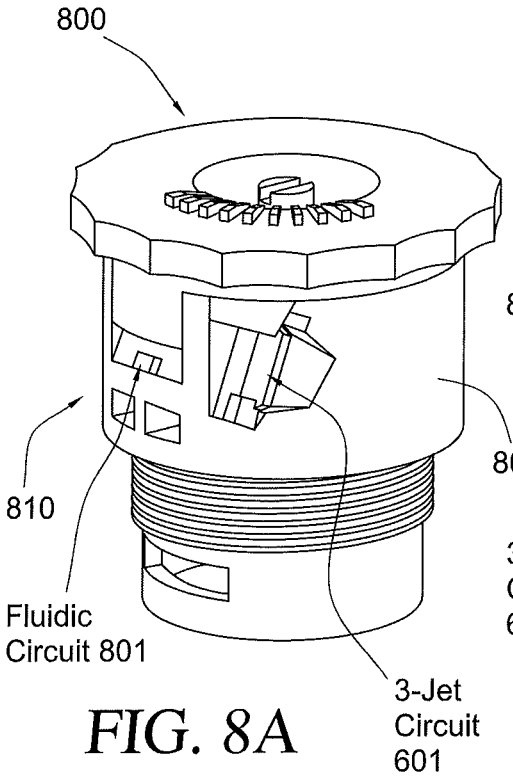
FIG. 8A is a perspective view of a fluidic pop-up irrigation nozzle or sprinkler head illustrating the placement of the 3-Jet fluidic nozzle spraying inserts, in accordance with the present invention.
Figure 8B:
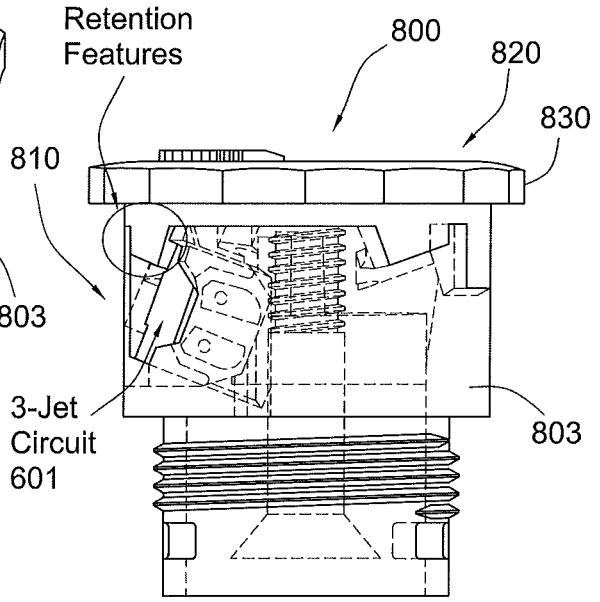
FIG. 8B is a partial cross sectional view, in elevation, of the fluidic pop-up irrigation nozzle of FIG. 8A, illustrating the placement of ports or slots configured to receive the 3-Jet fluidic nozzle spraying inserts, in accordance with the present invention.
Figure 8C:
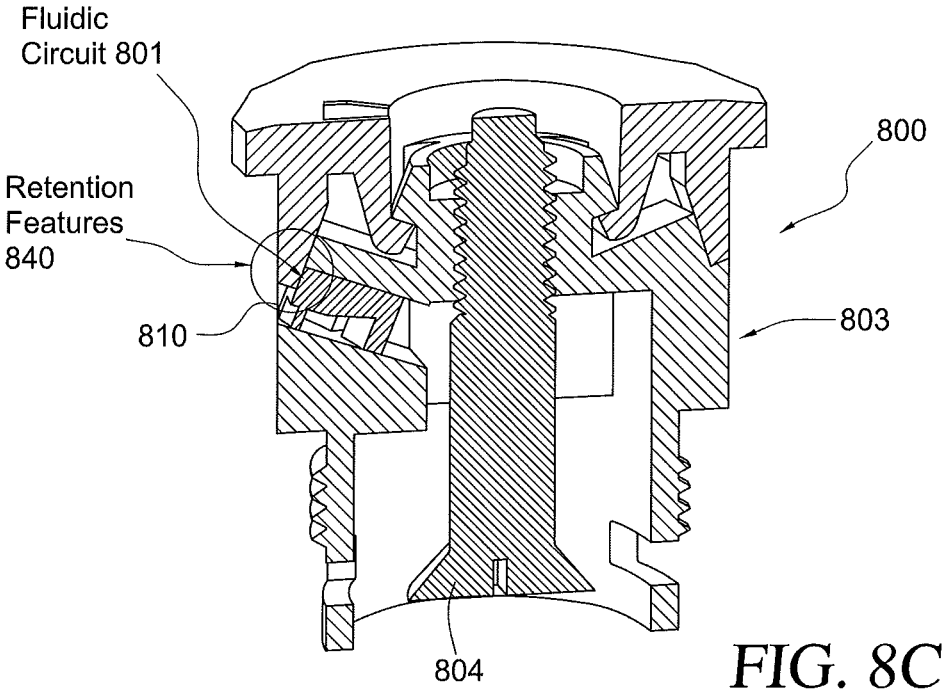
FIG. 8C is another partial cross sectional view, in elevation, of the fluidic pop-up irrigation nozzle of FIG. 8A, illustrating the placement of ports or slots configured to receive the other fluidic nozzle spraying insert and the retention feature, in accordance with the present invention.

An exemplary embodiment of an irrigation nozzle assembly or package 800 which houses and aims at least one of the first (fluidic) oscillators 801 and at least one of the second (3-jet) circuits 601 is shown in FIGS. 8A-C.

FIG. 8A is a perspective view of a fluidic irrigation nozzle or sprinkler head illustrating the placement of the 3-Jet fluidic nozzle spraying insert 601 and FIG. 8B is a partial cross sectional view, in elevation, of the fluidic pop-up irrigation nozzle of FIG. 8A, illustrating the orientation and placement of ports or slots configured to receive the 3-Jet fluidic nozzle spraying insert 601. FIG. 8C is another cross sectional view, in elevation, of the fluidic pop-up irrigation nozzle of FIG. 8A, illustrating the placement of ports or slots configured to receive the other fluidic nozzle spraying insert 801 and the retention feature.

As noted above, fluidic circuits are often configured for use in housings which define a channel, port or slot that receives and provides boundaries for the fluid paths defined in the fluidic circuit. For an illustrative example of how a fluidic oscillator or fluidic circuit 601 might be employed, a sprinkler or nozzle assembly 800 is configured with a substantially cylindrical housing 803 with a hollow interior. Housing 803 defines a substantially tubular fluid-impermeable structure and the housing sidewall includes an array of four upwardly angled ports or slots 810, each defining a substantially rectangular passage or aperture with smooth interior slot wall surfaces. The interior sidewall surfaces are preferably dimensioned for cost effective fabrication using molding methods and preferably include sidewall grooves positioned and dimensioned to form a "snap fit" with ridges or tabs in mating fluidic circuit inserts (e.g., 801) or blanks (not shown).

Nozzle assembly 800 can be configured to include one, two, three or four fluidic circuit inserts or chips which are dimensioned to be tightly received in and held by the radially arrayed slots 810 defined within the sidewall of housing 803. The ports or slots 810 provide a channel for fluid communication between the housing's interior lumen and the exterior of the housing. Housing 803 has a distal or top closed end with an axially aligned, threaded bore that threadably receives an axially aligned flow adjustment screw 804 which defines a flow-restricting valve plug end.

The cross sectional views of FIGS. 8B and 8C illustrate the fluidic irrigation nozzle assembly housing 803 slots 810 in cross section, when spray generating fluidic inserts 601, 801 have been inserted. In the elementary form, a selected fluidic insert (such as a 3-Jet circuit insert 601 is used to produce a selected pattern of spray. This could be a single spray or a double spray, where the fluidic insert has a fluidic geometry on both sides (top and bottom) of the insert.

The internal structures of the fluidic oscillators are further described in this applicant's other patents and pending applications. For example, the "Mushroom" oscillator as shown in FIG. 4 includes an oscillation inducing chamber described in U.S. Pat. No. 6,253,782 (and an improved mushroom is described in U.S. Pat. No. 7,267,290); the "Double Spray" configuration is described in U.S. Pat. No. 7,014,131; the "Three Jet" island oscillator has power nozzles feeding an interaction region and is described in U.S. Patent Application Publication 2005/0087633. The entire disclosure of each the foregoing patents and published applications are incorporated herein by reference.

In more general terms, housing 803 provides an enclosure for a fluidic oscillator or circuit (e.g., 601) that operates on a pressurized fluid or liquid flowing through the oscillator to generate a liquid jet that flows from the oscillator and into a surrounding environment to form an oscillating spray of liquid droplets, where the oscillator has a boundary surface fabricated therein defining a channel (bounded by port 810) to provide a fluidic circuit whose geometry is configured to aid in establishing the oscillating nature of the spray of liquid droplets. Enclosure 803 includes or defines a body having an interior and an exterior surface; where a first portion of the interior surface is configured to attach to the oscillator boundary surface and form with the channel 810 an enclosed pathway through which the liquid flows.

To prevent the circuit inserts (e.g., 601 or 801) from being blowing out by a high pressure surge of irrigation fluid in the supply lines, there are retention features 840 (downwardly projecting encircling wall segments for the fluidic insert and triangular shape wall segments for the 3-jet insert) as indicated in FIG. 8C. The nozzle assembly or package of FIGS. 8A-8C provides a spray pattern optimized for a 4 ft×15 ft LCS (Left Corner Strip). A 4 ft×9 ft LCS spray pattern will be obtained if only the 3-jet circuit 601 is used. This package could be easily developed into RCS (Right Corner Strip) or SST (Side Strip) housing by providing similar features, but reversed in mirror image fashion.

Besides low PR, high CU (coefficient of uniformity), high DU (distribution uniformity) and low SC (scheduling coefficient) are critical evaluation factors for irrigation spray performance. The substantially rectangular overlap spray pattern (near spray Pattern 690 and far spray pattern 711) results from use of the two circuits, as shown in FIG. 7, and significantly affects the spray uniformity, especially when performing a head to head overlap spray.

Figure 9:
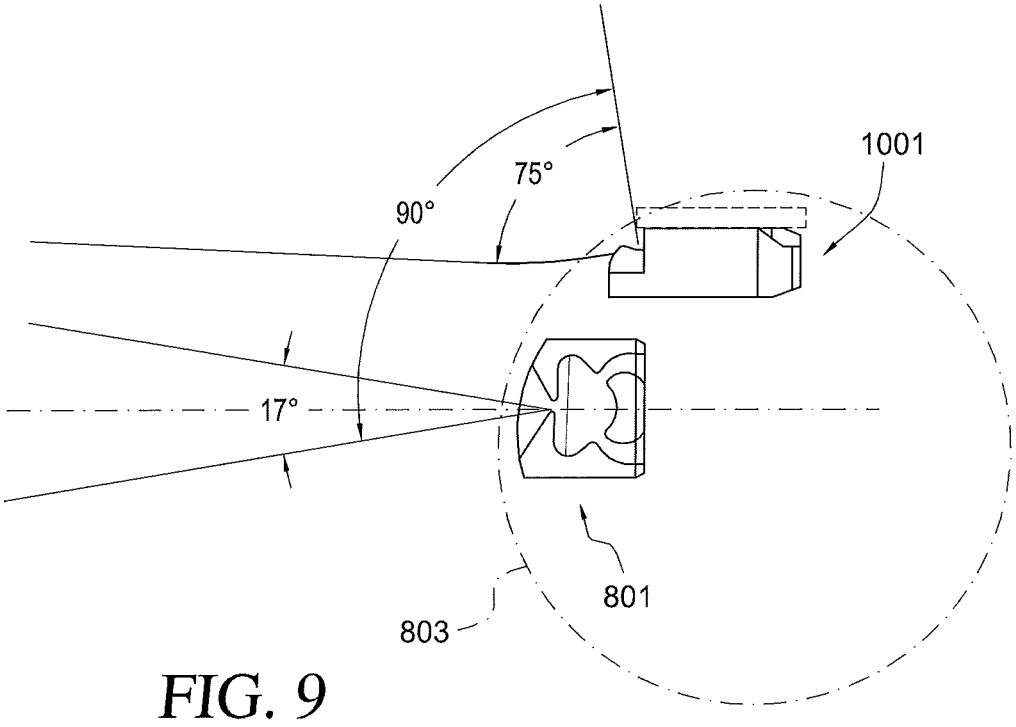
FIG. 9 illustrates another combination of spray fans from two circuits, in accordance with the present invention.
Figure 10A:
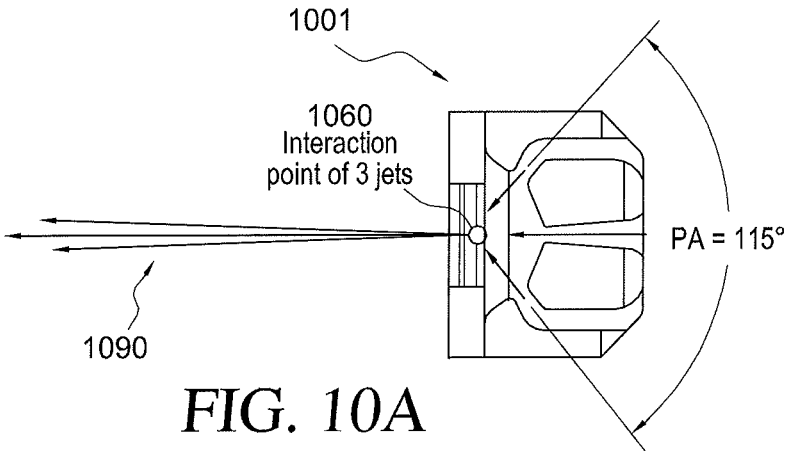
FIG. 10A illustrates the interior features in elevation for another exemplary embodiment of the 3-Jet fluidic nozzle spraying insert, in accordance with the present invention.
Figure 10B:
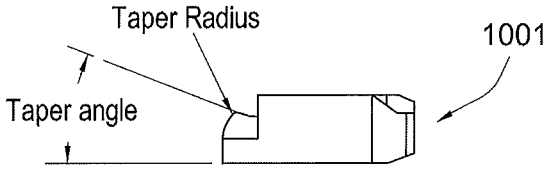
FIG. 10B illustrates a side view in elevation and partial section the 3-Jet fluidic nozzle spraying insert of FIG. 6A, in accordance with the present invention.
Figure 11:
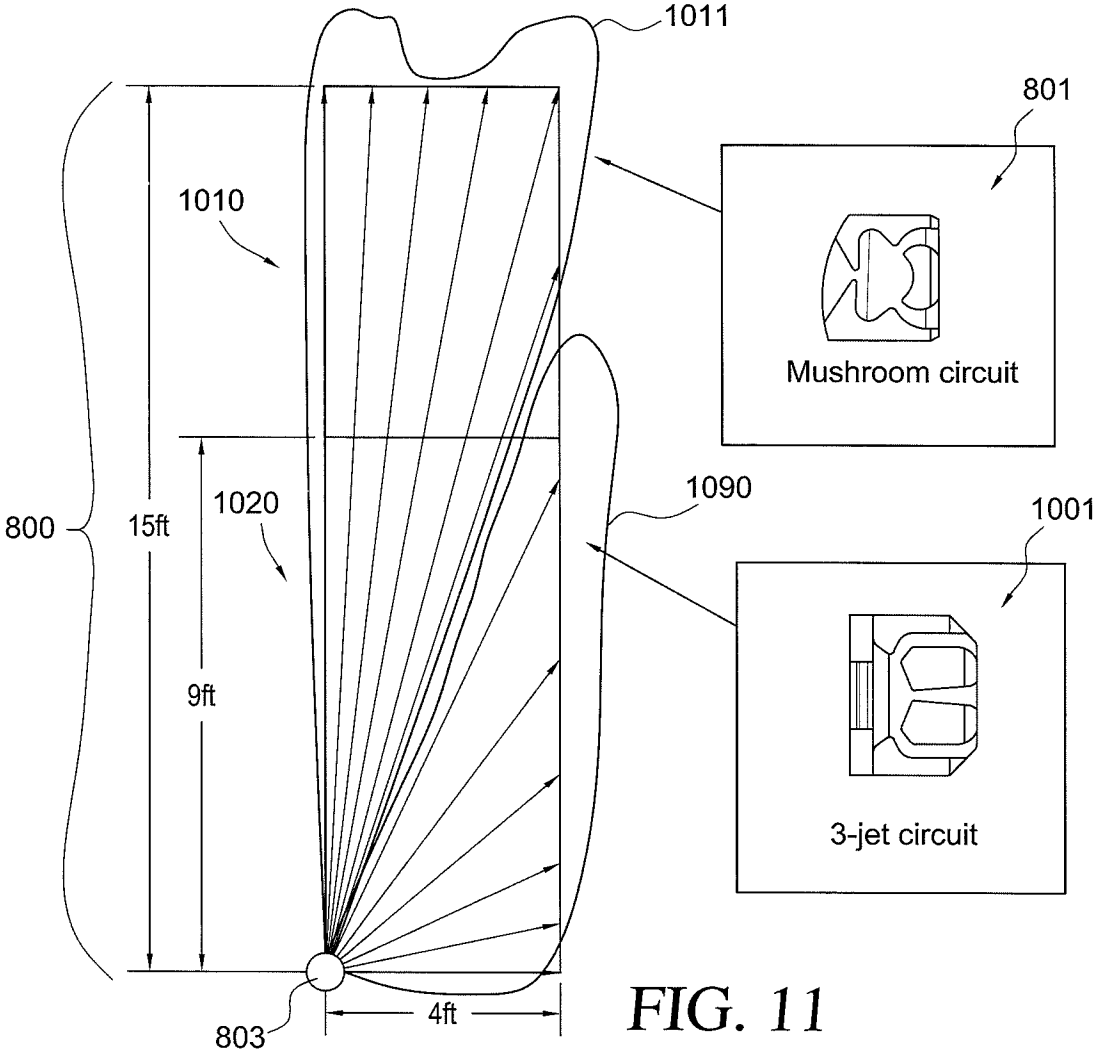
FIG. 11 is an X-Y diagram with angular graduations illustrating the observed throw pattern for a rectangular irrigation area when sprayed using the irrigation nozzle assembly of FIG. 9, in accordance with the present invention.
Figure 12:
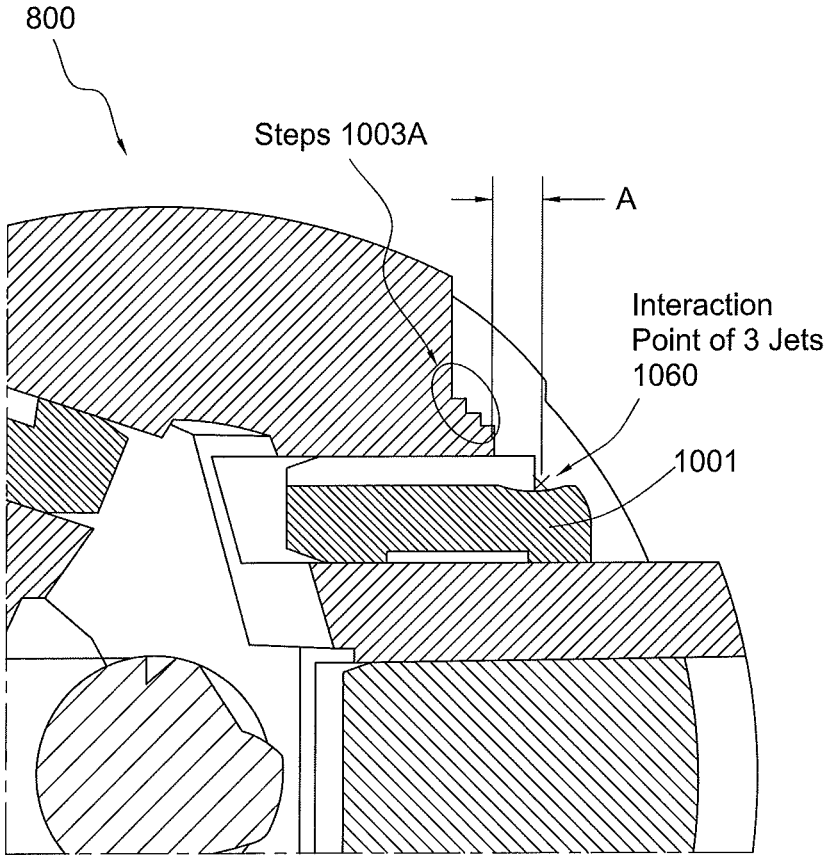
FIG. 12 is a partial cross sectional view illustrating the "steps" for spray attachment at lower flow rates in an embodiment of the sprinkler housing, in accordance with the present invention.

An irrigation nozzle configuration providing a more uniform combination of the spray fans from two circuits with little overlap is provided by the embodiment illustrated in FIGS. 9 and 11. By carefully adjusting the taper feature (taper angle and taper radius, as illustrated in FIG. 10) of the 3-jet insert 1001 and by adjusting the distance between deflection wall of housing and the spray nexus or interaction point 1060 defined by the three impinging jets (see Dimension A as shown in FIG. 12), a triangular shaped spray pattern is achieved as shown in FIGS. 9 and 10. This "almost no overlap" spray configuration yields significant improved CU, DU and SC.

In use, when the flow is reduced using the flow control screw 804, the fan angle of the 3-jet circuit tends to decrease at low enough flow rates (approx. 70% flow). In order to alleviate this, applicants have discovered that adding external "steps" 1003A on the housing 1003, proximate the fluidic's outlet is beneficial (i.e., proximate nexus or impingement point 1060, as shown in FIG. 12). Housing "steps" 1003A cause the spray to attach and help expand the fan angle.

The structure and method of the present invention permit persons having skill in the art to irrigate a substantially rectangular irrigation target area (e.g., 1010 and 1020) with very little overspray and waste. It will be appreciated that a method for such irrigation, in accordance with the present invention comprises the method steps of providing an irrigation nozzle with a 3-jet fluidic circuit (e.g., 501, 601 or 1001) configured to generate first, second and third jets directly impinging upon a spray nexus point (e.g., 1060) to generate a substantially planar resultant spray pattern (e.g., 1090), where the 3-jet fluidic circuit has a selected floor geometry and selected taper features configured to create the rectangular spray pattern, and then aiming the irrigation nozzle by orienting the 3-jet fluidic circuit's resultant spray pattern to substantially overlap at least part of the irrigation target area.

It will be appreciated by those of skill in the art that the nozzle assembly of the present invention will find applications beyond those described here for use in irrigation, since sprays of many kinds of fluids are required for various applications. To cite a single example, many windshields are substantially rectangular, and so washer fluid might be applied with one or more of the configurations described here. Broadly speaking, the nozzle assembly of the present invention includes a 3-jet fluidic circuit configured (e.g., as in FIGS. 5A-6B) to generate a spray pattern that is substantially rectangular by combining (or colliding) first, second and third jets into a spray nexus point to generate a resultant substantially planar spray pattern (e.g., 690) comprised of fluid droplets having trajectories which vary periodically in azimuth and throw to substantially fill a rectangular spray area with very little overspray or waste (low PR).

The nozzle assembly of the present invention also provides an inexpensive, durable and efficient irrigation nozzle adapted to generate a specialized rectangular spray resulting from a confluence of three jets within a 3-jet fluidic circuit having a selected floor geometry and selected taper features configured to create a customizable rectangular spray pattern; where, depending on the throw desired, the nozzle assembly can (as shown in FIGS. 8A-8C) be combined with a second fluidic circuit (e.g., 801) configured to generate a "flat fan" spray pattern to provide a range of desired aspect ratios in a rectangular-shaped spray of irrigation fluid.

Figure 13:
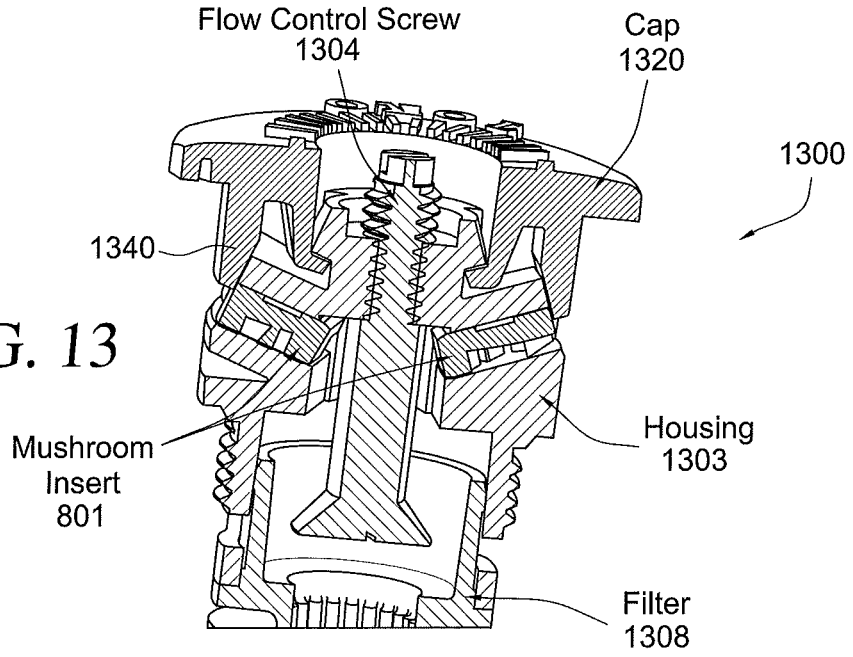
FIG. 13 is a cross sectional view, in perspective illustrating an SST sprinkler assembly and the retention features, in accordance with the present invention.

Turning now to FIG. 13, the package design for rectangular strip nozzles with the present invention presented significant challenges due to the perpendicular slot orientations, i.e., for the horizontally aligned mushroom jet insert (e.g., 801) and the vertically aligned 3-jet insert (e.g., 601 or 1001). A conventional irrigation nozzle comprises at least a housing, a filter and a flow control screw. In order to be compatible with the current standard commercial irrigation riser, irrigation nozzles with fluidic assemblies of present invention have to match the outer profiles of conventional irrigation nozzles (e.g., as used in pop-up sprinkler assemblies). FIG. 13 illustrates a cross section view in perspective for a SST nozzle assembly 1300 with the fluidic assemblies of the present invention, and shows the configuration and assembly details of the housing 1303, filter 1308 and flow control screw 1304, as well as first fluidic insert 801, second fluidic insert 1001, third fluidic insert 1001 and fourth fluidic insert 801, all beneath cap 1320 which preferably bears indicia on the top surface flange (e.g., of sprinkler head model indication) and cap 1320 carries downwardly depending circumferential wall segments 1340 which define insert retention members. Housing, design is complicated because of the following reasons:

1. The outer profile should be the same as for a conventional (prior art) nozzle;
2. Perpendicular orientation layout of (a) the mushroom insert 801 and (b) the 3-jet insert (e.g., 1001);
3. Insert retention members 1340 are required to retain the fluidics when pulsed with fluid pressure from within;
4. Nozzle assembly is preferably molded (e.g., from plastic) using a single mold base with exchangeable tool slides (for different configurations) for the sake of cost saving;
5. Nozzle assembly 1300 should survive dry retraction test (e.g., impact with 12 inch riser for 10 times);
6. Enough room for filter 1308 and flow control screw 1304 to function properly; and
7. Nozzle assembly 1300 must be Tooling/molding friendly.

Figure 14A:
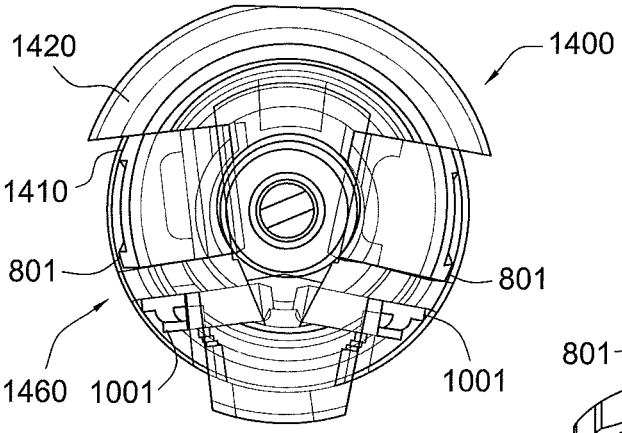
FIGS. 14A and 14B illustrate another SST housing and the circumferentially projecting protective riser impact area flange, in accordance with the present invention.
Figure 15A:
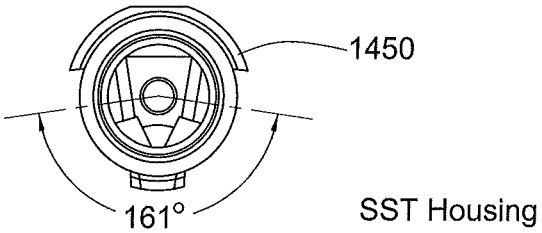
FIGS. 15A 15B illustrate the SST housing of FIG. 14B and the circumferential extent of protective riser impact area flange, in accordance with the present invention.

FIG. 14A shows the insert layout of another SST nozzle assembly 1400. First and second 3-jet inserts 1001 are arranged vertically in the side of body cylinder wall in order to gain enough sealing for the fluidic circuit to perform properly. Two symmetrical mushroom inserts 801 are arranged horizontally to just give enough room for filter 1408 and flow control screw 1304. Both the slot 1410 for the mushroom circuit 801 and the slot 1460 for the 3-jet fluidic 1001 have the same aim angle so that they can be molded by the same tool slide. The major advantage of using exchangeable tool slides for molding the slots is cost saving on using the same mold for different housing configuration such as LCS, RCS or SST. FIGS. 15A-17B illustrate a layout of different housing configurations adapted for manufacture with the same tool base. As shown in FIG. 15A, an angle of 161 deg is chosen between the two mushroom slots in the SST configuration, based on the individual spray angles.

A spring-like biased flange member is defined in cap 1420 and is configured to releasably engage a vertically projecting boss on housing 1403 and the snap-fit engagement between cap 1420 and housing 1403 is strong enough to fixedly support retaining wall segments 1440 and thereby hold or retain each insert (e.g., 801 and 1001) from being blown out of its respective port or slot (e.g., (1410 or 1460) when slammed from within by inrushing fluid's water-hammer like surge pressure.

Figure 14B:
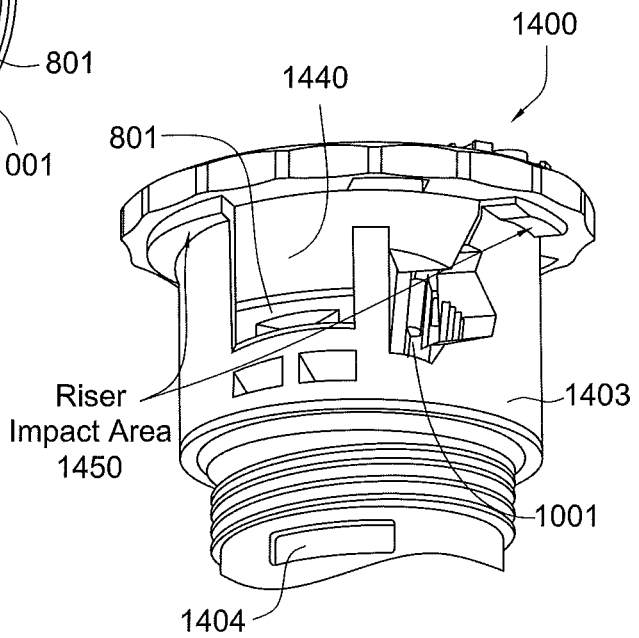

In the event that retainer wall segment 1440 is not affixed with adequate force strong enough to survive impact from riser, an outer circumferential segment or flange 1450 is optionally incorporated into housing 1403 and is designed to protrude laterally from between the cap pockets so that flange 1450 will receive the impact force from the riser (as shown in FIG. 14B). When a riser impacts laterally projecting flange segments 1450, cap 1420 is not subjected to the upward impact from the retraction force.

Figure 15B:
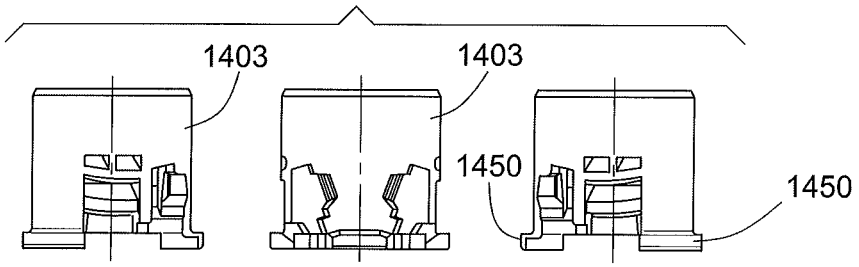

The bottom or interior view of FIG. 15A and the three side views of FIG. 15B illustrate an SST housing 1403 and the circumferential extent of protective riser impact area flange 1450, in accordance with the present invention.

Figure 16A:
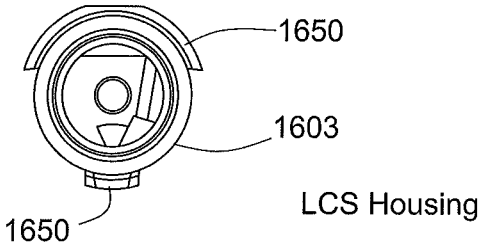
FIGS. 16A and 16B illustrate an LCS housing and the circumferential extent of protective riser impact area flange, in accordance with the present invention.
Figure 16B:
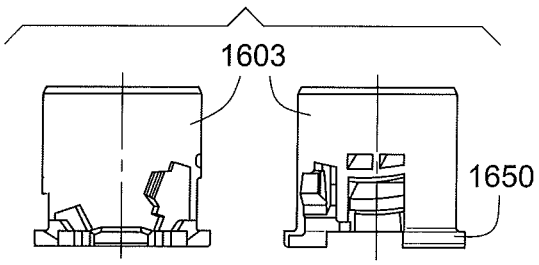

The bottom or interior view of FIG. 16A and the two side views of FIG. 16B illustrate an LCS housing 1603 and the circumferential extent of protective riser impact area flange 1650, in accordance with the present invention.

Figure 17A:
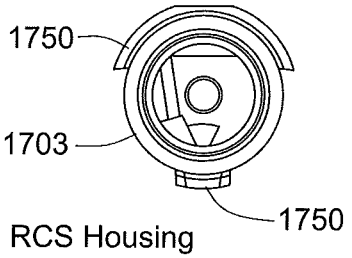
FIGS. 17A and 17B illustrate an SST housing and the circumferential extent of protective riser impact area flange, in accordance with the present invention.
Figure 17B:
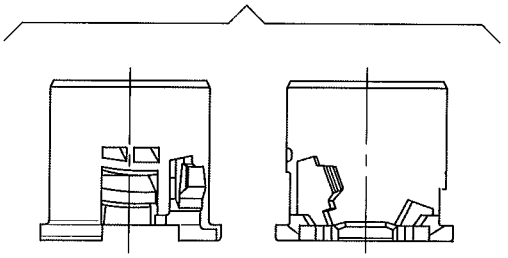

The bottom or interior view of FIG. 17A and the two side views of FIG. 17B illustrate an SST housing 1703 and the circumferential extent of protective riser impact area flange 1750, in accordance with the present invention.

Persons of skill in the art will appreciate that, broadly speaking, the present invention provides an irrigation nozzle assembly with a housing (e.g., 1303 or 1403) including an interior lumen and an exterior sidewall, with at least one 3-jet fluidic-circuit-receiving port (e.g., 1460) defining a fluid passage between the lumen and the housing's sidewall; the 3-jet circuit (e.g., 1001) is configured to receive fluid passing into the housing lumen and, in cooperation with the port, passes the fluid beyond the sidewall, projecting the fluid in a desired spray pattern. The 3-jet fluidic insert has a proximal intake that is in fluid communication the said housing's interior lumen and a distal outlet that is positioned and configured to project the desired spray pattern outwardly and away the said housing's exterior sidewall, and the irrigation nozzle further includes a retention member (e.g.,

1340 or 1440) configured to fit over the housing's exterior sidewall to engage and hold all of the inserted fluidic inserts and retain them in-situ.

In the embodiments of FIGS. 14A-15B, irrigation nozzle 1400 has a housing exterior sidewall which also includes at least one radially projecting circumferential wall segment 1450 configured to provide a riser impact surface, and the irrigation nozzle retention member 1440 comprises wall segments 1440 separated by or defined with gaps or cap pockets dimensioned to receive the radially projecting circumferential wall segments 1450 which provide the riser impact surface.

Having described preferred embodiments of a new and improved structure and method, it is believed that other modifications, variations and changes will be suggested to those skilled in the art in view of the teachings set forth herein. It is therefore to be understood that all such variations, modifications and changes are believed to fall within the scope of the present invention, as set forth in the claims.

What is claimed is:

1. An inexpensive, durable and efficient irrigation nozzle adapted to generate a specialized rectangular spray, comprising:

a 3-jet fluidic circuit configured to generate first, second and third jets directly impinging upon a spray nexus point to generate a substantially planar resultant spray pattern, said 3-jet fluidic circuit having a selected floor geometry and selected taper features configured to create a first spray pattern comprising a first part of a substantially rectangular irrigation target area;

said irrigation nozzle being configured to generate a second spray pattern which, together with said first spray pattern, comprise a substantially rectangular spray covering said substantially rectangular irrigation target area.

2. The irrigation nozzle of claim 1, further comprising a second fluidic circuit receiving port;

wherein, depending on the throw desired, said 3-jet circuit can be combined with a second fluidic circuit configured to generate a "flat fan" spray pattern when affixed within said port to provide said second spray pattern having a range of desired aspect ratios comprising a second part of said rectangular spray covering said substantially rectangular irrigation target area.

3. The irrigation nozzle of claim 1, further comprising:

a housing including an interior lumen and an exterior sidewall, with at least one 3-jet fluidic-circuit-receiving port defining a fluid passage between said lumen and said sidewall;

said 3-jet circuit being configured to receive fluid passing into said housing lumen and, in cooperation with said port, pass said fluid beyond said sidewall, projecting said fluid in a desired spray pattern;

wherein said 3-jet fluidic insert has a proximal intake that is in fluid communication with said housing's interior lumen and a distal outlet that is positioned and configured to project said desired spray pattern outwardly and away from said housing's exterior sidewall, and said irrigation nozzle further including a retention member configured to fit over said housing's exterior sidewall to engage said fluidic insert and retain said fluidic insert in-situ.

4. The irrigation nozzle of claim 1, wherein said 3-jet fluidic circuit is configured as an insert received in a first port oriented to aim said first spray pattern;

wherein said irrigation nozzle further comprises a second port oriented to receive and aim a second fluidic circuit configured to generate a "flat fan" spray pattern to generate said second spray having a range of desired aspect ratios, wherein said first spray, when combined with said second spray comprise said rectangular spray covering said substantially rectangular irrigation target area.

5. The irrigation nozzle of claim 4, wherein said irrigation nozzle is configured for use in a pop-up nozzle assembly.

6. The irrigation nozzle of claim 5, further comprising:

a pop-up irrigation nozzle assembly housing including an interior lumen and an exterior sidewall with said first 3-jet fluidic-circuit-receiving port defining a fluid passage between said lumen and said sidewall;

said first 3-jet circuit being configured to receive fluid passing into said housing lumen and, in cooperation with said port, pass said fluid beyond said sidewall, projecting said fluid in said first spray pattern;

wherein said first 3-jet fluidic insert has a proximal intake that is in fluid communication with said housing's interior lumen and a distal outlet that is positioned and configured to project said first spray pattern outwardly and away from said housing's exterior sidewall, and said irrigation nozzle further including a retention member configured to fit over said housing's exterior sidewall to engage said first fluidic insert and retain said fluidic insert in-situ.

7. The irrigation nozzle of claim 6, wherein said irrigation nozzle's second fluidic circuit has a proximal intake that is in fluid communication with said housing's interior lumen and a distal outlet that is positioned and configured to project said second spray pattern outwardly and away from said housing's exterior sidewall, and said irrigation nozzle's retention member is configured to fit over said housing's exterior sidewall to engage said second fluidic insert and retain said second fluidic insert in-situ.

8. The irrigation nozzle of claim 6, wherein said irrigation nozzle's first and second sprays combine with almost no overlap to irrigate said substantially rectangular irrigation target area with very little wasted irrigation fluid from overspray outside the rectangular irrigation target area.

* * * * *